US005087174A

United States Patent [19]

Shannon et al.

[11] Patent Number: 5,087,174

[45] Date of Patent: Feb. 11, 1992

[54] TEMPERATURE ACTIVATED EXPANDING MINERAL SHIM

[75] Inventors: Robert E. Shannon, Penn Township, Westmoreland County; William G. Clark, Jr., Murrysville Boro, both of Pa.

[73] Assignee: Westinghouse Electric Corp., Pittsburgh, Pa.

[21] Appl. No.: 468,345

[22] Filed: Jan. 22, 1990

[51] Int. Cl.[5] ..... F01D 5/30

[52] U.S. Cl. ..... 416/220 R; 416/241 R; 29/889.21; 403/374

[58] Field of Search ..... 416/204 A, 219 R, 220 R, 416/241 R, 241 A, 248; 29/889.21; 403/28, 29, 30, 374; 277/26; 252/378 R, 378 P

[56] References Cited

U.S. PATENT DOCUMENTS

| | | | |
|---|---|---|---|
| 3,317,988 | 5/1967 | Endres | 416/220 R |
| 3,323,394 | 4/1972 | Hoffmuller et al. | 29/889.21 |
| 3,784,320 | 1/1974 | Rossmann et al. | 416/219 R |
| 3,910,719 | 10/1975 | Hessler et al. | 416/219 R |
| 4,169,694 | 10/1979 | Sanday | 416/219 R |
| 4,417,854 | 11/1983 | Cain et al. | 416/219 R |
| 4,790,723 | 12/1988 | Wilson et al. | 416/220 |

FOREIGN PATENT DOCUMENTS

| | | | |
|---|---|---|---|
| 879488 | 6/1953 | Fed. Rep. of Germany | 416/219 R |
| 3236021 | 5/1983 | Fed. Rep. of Germany | 416/219 R |
| 836030 | 6/1960 | United Kingdom | 416/221 |

*Primary Examiner*—Edward K. Look
*Assistant Examiner*—James A. Larson

[57] ABSTRACT

A method and apparatus for securing or attaching a rotor blade with a turbine rotor cavity by disposing an expanding material between the blade root and the cavity walls. The expanding material comprises a naturally occurring mineral which expands to a great degree when exposed to elevated temperatures. The expanding material may be provided in the form of shims made directly from the expanding material or made from a composition of the expanding material and a binder such as a polymer or elastomer. Alternatively, the expanding material may be provided in the form of a liquid vehicle applied to surfaces of the cavity walls. The expanding material is located at specific positions within the cavity to urge certain surfaces of the blade root against certain surfaces of the cavity walls. In this manner, the blade can be forced into a tight fit and an aligned position, with respect to the rotor, upon expansion of the expanding material.

22 Claims, 3 Drawing Sheets

TEMPERATURE ACTIVATED EXPANDING MINERAL SHIM

BACKGROUND OF THE INVENTION

The present invention relates to a method and apparatus for securing a turbine blade to a turbine rotor.

Modern steam and gas turbines generally employ blade and rotor designs which provide for mechanical attachment or securing of a turbine blade to a turbine rotor. Generally, several turbine blades are attached to a singler rotor.

Conventional attachment schemes for attaching one of the blades to the rotor typically include an elongated triangular blade root which extends from the base of the blade, and a mating elongated triangular cavity provided in the rotor (the blade root and the cavity are triangular in cross-section). The outer periphery of the blade root is typically provided with a wavy configuration forming a plurality of outwardly extending lugs and inwardly directed grooves. Similarly, the wall of the rotor cavity is provided with a wavy configuration forming a plurality of outwardly extending lugs and inwardly extending grooves. When attached, the blade root is fitted into the rotor cavity such that the outwardly extending lugs of the blade root extend into the inwardly extending grooves of the cavity wall, and the outwardly extending lugs of the cavity wall extend into the inwardly extending grooves of the blade root.

FIG. 1 shows a cross section of a portion of a conventional turbine rotor 10 and several conventional blades 12 attachable to turbine rotor 10. As shown in FIG. 1, each blade 12 includes a base portion 14 from which a blade root 16 extends. As described above, turbine rotor 10 is provided with cavities 18 in which blade roots 16 extend.

Rotor 10 has an outer peripheral surface 20 in which several blade root grooves or cavities 18 are provided. The portions 22 of rotor 10 which are located between cavities 18 are typically called disc steeples.

Also as described above, the outer peripheral surface of each blade root 16 is provided with a wavy configuration forming several outwardly extending lugs 24 and several inwardly extending grooves 26. The walls of each cavity 18 are also provided with a wavy configuration forming several outwardly extending lugs 28 and inwardly extending grooves 30. When attached, the outwardly extending lugs 24 of blade root 16 extend into inwardly extending grooves 30 of the walls of cavity 18. Also, outwardly extending lugs 28 of the walls of cavity 18 extend into inwardly extending grooves 26 of blade root 16. Optimally, blade root 16 is fitted tightly or snugly within cavity 18, such that no, or a minimum amount of, clearance exists between blade root 16 and disc steeples 22. Such a tight or snug fit insures that blade 12 will not move or vibrate with respect to rotor 10 during operation of the turbine. Additionally, such tight or snug fitting insures that blade 12 maintains a proper alignment (e.g., radial alignment) with respect to rotor 10 and/or with respect to the cavity 18.

Referring again to FIG. 1, each groove 30 is provided with a first surface 32 (located at the upper portion of each groove 30 shown in FIG. 1) and a second surface 34 (located at the bottom portion of each groove 30 shown in FIG. 1). First surfaces 32 extend into the wall of cavity 18 at an angle $\alpha$ with respect to the central axis of cavity 18. Second surfaces 34 extend into the wall of cavity 18 at an angle $\beta$ with respect to the central axis of cavity 18. Preferably, the angle $\alpha$ is greater than the angle $\beta$.

Similarly, outwardly extending lugs 24 of each blade root 16 include first surfaces 36 (located on the upper portion of each lug 24 shown in FIG. 1) and second surfaces 38 (located at the lower portion of each lug 24 shown in FIG. 1). First surfaces 36 extend at an angle $\alpha$ with respect to the central axis of blade root 16 and second surfaces 38 extend at an angle $\beta$ with respect to the central axis of blade root 16. This arrangement is intended to provide sufficient contact area between the surface 36 of each lug 24 and surface 32 of each groove 30 of each cavity 18. In this manner, operating stresses are exerted primarily between surface 32 of each groove 30 and surface 36 of each lug 24.

Although this design has been successful for a number of years, such problems as cracking of the blade root lugs tend to occur. Such cracking problems have been attributed to improper seating of lugs 24 within grooves 30. This problem has been found to be exacerbated by various operations carried out during turbine overhauls.

Such turbine overhaul operations tend to cause the groove and lug profile of cavities 18 to lose dimensional tolerances. That is, such turbine overhauls tend to change the shape or dimension of grooves 30 and lugs 28 provided in the walls of cavities 18 by removing portions of, or wearing away, the metal forming disc steeples 22. As a result, a blade root 16 inserted in cavity 18 of an overhauled turbine rotor 10 may not fit snugly within cavity 18.

Such loose fitting of blade root 16 within cavity 18 may allow blade 12 to vibrate or move with respect to rotor 10 during the operation of the turbine. This movement or vibration of a rotor blade 12 with respect to a rotor 10 can cause excessive damage to the walls of cavity 18 and to blade root 16 Also, such movement or vibrations can cause excessive frictional heating between blades 12 and rotor 10 and/or with respect to the cavity 18.

Prior methods of alleviating problems associated with a loosely fitting blade have included the use of a conventional metal shim placed between the lowermost portion (with respect to FIG. 1) of blade root 16 and rotor 10. However, since a rotor overhaul creates a loss of metal which is usually non-uniform about grooves 30 and lugs 28, current shimming techniques often result in blades 12 not being radially aligned or centered in cavity 18 and in blades 12 not seating tightly in cavities 18.

SUMMARY OF THE INVENTION

It is therefore an object of the present invention to provide a method and apparatus for securing or attaching a rotor blade with a turbine rotor and which provides a snug or tight fit even when the outer peripheral dimensions of the blade root do not match exactly with the peripheral dimensions of a cavity formed in the rotor.

It is also an object of the present invention to provide a method and apparatus for attaching or securing a blade to a rotor in a manner which maintains accurate alignment (e.g., radial alignment) with respect to the rotor.

These and other objects are accomplished according to the present invention by disposing an expanding material between the blade root and the cavity walls. In an embodiment of the present invention, the expanding material comprises a naturally occurring mineral which expands to a great degree when exposed to elevated temperatures. The expanding material may be provided in the form of shims made directly from the expanding material or made from a composition of the expanding material and a binder such as a polymer or elastomer. Alternatively, the expanding material may be provided in the form of a liquid vehicle applied to surfaces of the cavity walls.

According to an embodiment of the present invention, the expanding material (in the form of shims or in a liquid vehicle) is located at specific positions within the cavity to urge certain surfaces of the blade root against certain surfaces of the cavity walls. In this manner, the blade can be forced into a tight fit and an aligned position, with respect to the rotor, upon expansion of the expanding material.

The expanding material may be any suitable material which exhibits a relatively great degree of expansion upon heating. Examples of such materials are vermiculite and perlite. These materials are particularly suitable for the present invention because they retain their expanded dimensions even after returning to a lower temperature.

As a result of the expansion of the expanding material arranged between the blades and the rotor, the blades will be urged into a tightly fitting contacting arrangement with respect to the rotor. Additionally, the blades can be forced into an aligned position (e.g., radially aligned) with respect to the rotor. By virtue of such tight or snug fitting of the blade in the rotor cavity, the blade will be hindered from movement or vibration with respect to the rotor cavity. Thus, excessive damage or heating caused by movement or vibration of the blade with respect to the rotor can be minimized. Moreover, accurate alignment of the blade with respect to the rotor can be insured and maintained during the operation of the turbine.

BRIEF DESCRIPTION OF THE DRAWINGS

The detailed description of the invention will be made with reference to the accompanying drawings, wherein like numerals designate corresponding parts in the several figures.

DESCRIPTION OF THE PREFERRED EMBODIMENTS

The following detailed description is of the best presently contemplated mode of carrying out the invention. This description is not to be taken in a limiting sense, but is made merely for the purpose of illustrating the general principles of the invention. The scope of the invention is best defined by the appended claims.

In the following description, embodiments of the present invention are discussed in relation to a turbine, such as for a modern steam or gas turbine system. However, it will be recognized that the present invention may be applied to any system in which a rotor blade is secured with a rotor.

Figure 2:
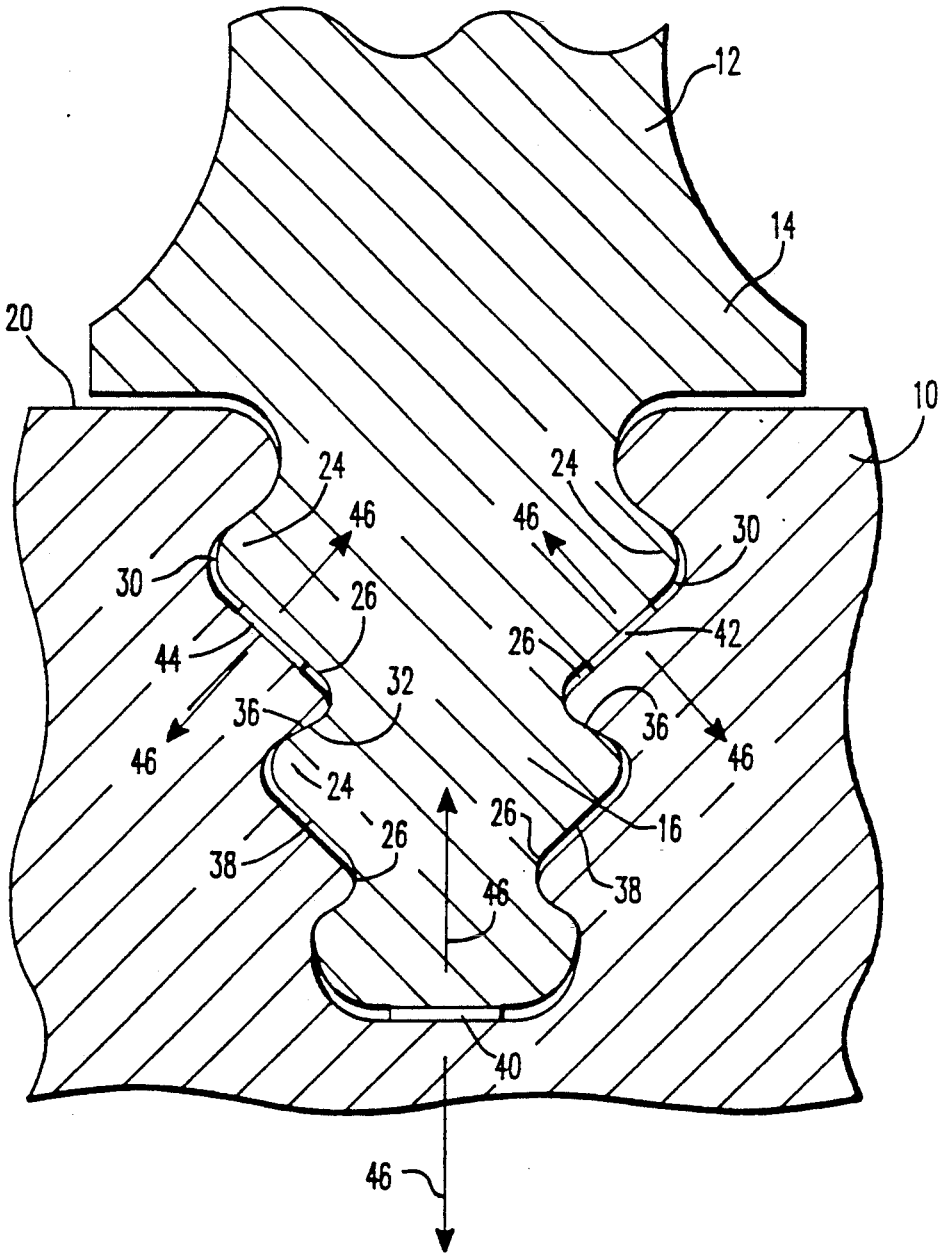
FIG. 2 is a cross-sectional view of a portion of a turbine rotor and a turbine blade secured with the turbine rotor according to an embodiment of the present invention.
Figure 3:
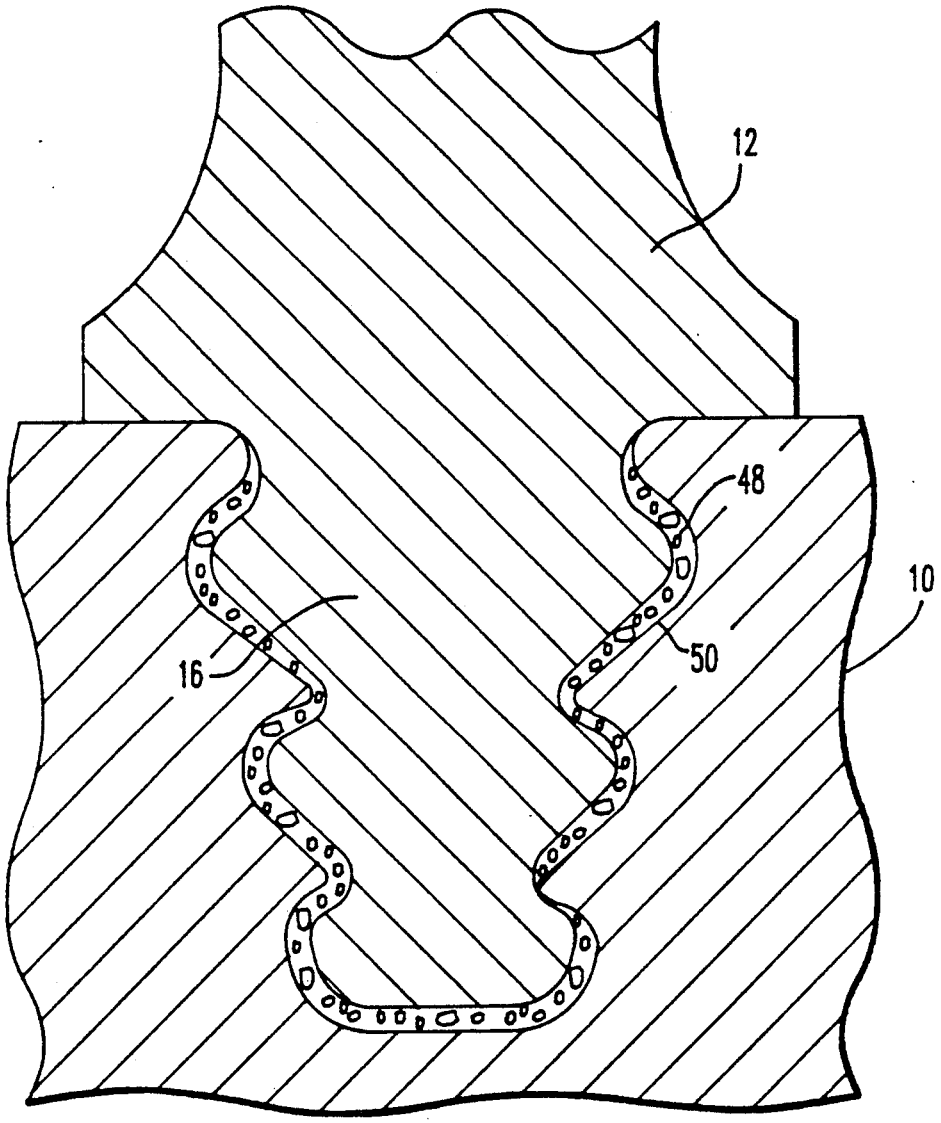
FIG. 3 is a cross-sectional view of a portion of a turbine rotor and a turbine blade secured with the turbine rotor according to another embodiment of the present invention.

Each of FIGS. 2 and 3 is a cross-sectional view of a portion of a turbine rotor and a turbine blade. FIGS. 2 and 3 show first and second embodiments, respectively, of a scheme for securing or attaching the turbine blade to the turbine rotor. Each of these embodiments employs a naturally occurring mineral that expands to a great degree when exposed to an elevated temperature. Two such minerals that exhibit this property are vermiculite and perlite. However, it will be appreciated that man-made expanding materials or composites can be employed with or instead of the naturally occurring expandible mineral and are considered to be within the scope of the present invention.

Specifically, vermiculite is a hydrated magnesium-aluminum-iron sheet silicate of variable compositions. The general formula for vermiculite is $(OH)_2(Mg,Fe)_3(Si,Al,Fe)_{4-O10}.4H_2O$.

Vermiculite may be regarded as a hydrated biotite where the crystalline layers are separated by a double layer of water molecules. Vermiculite possesses the property of exfoliating to a remarkable degree when strongly heated, due to the formation of steam between the crystalline layers. This exfoliation phenomenon causes vermiculite, when heated, to increase in volume by up to 12 times, or greater, its initial volume in a cool (or room temperature) state. This substantial increase in volume can occur over a temperature range of 800° F. to 2000° F.

Figure 1:
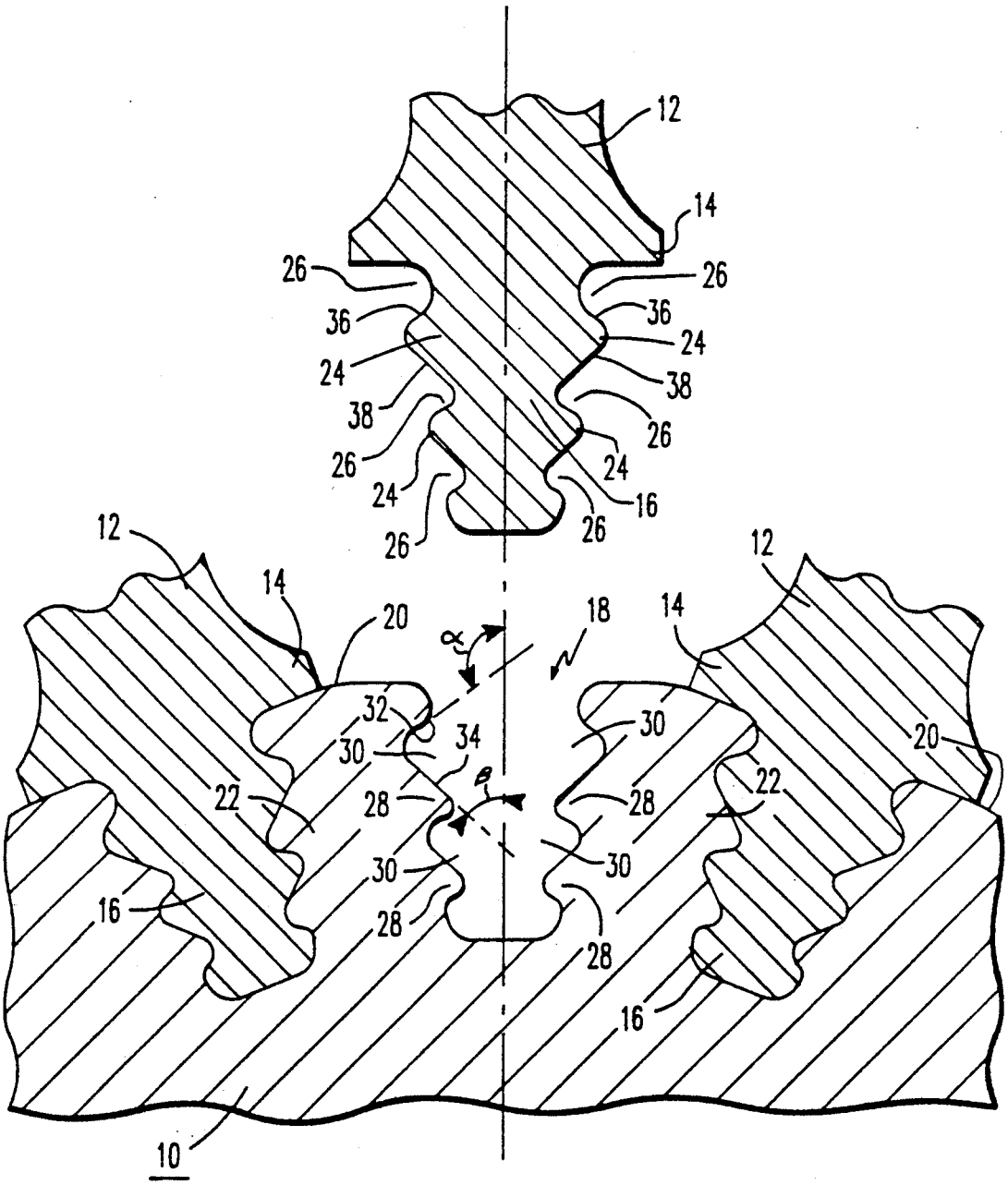
FIG. 1 PRIOR ART
FIG. 1 is a cross-sectional view of a portion of a conventional turbine rotor and conventional turbine blades.

In the FIG. 2 embodiment, a blade 12 is shown as having a base portion 14 and a root 16 extending from base portion 14 as described above with reference to FIG. 1. Also as described with reference to FIG. 1, root 16 includes a plurality of outwardly extending lugs 24 and a plurality of inwardly extending grooves 26. Each lug 24 has a first surface 36 (shown on the upper portion of lugs 24 in FIG. 2) and a second surface 38 (shown on the lower portion of lugs 24 in FIG. 2).

Root 16 is shown as being fitted within a cavity 18 of rotor 10. As described above with reference to FIG. 1, blade root groove or cavity 18 extends into outer peripheral surface 20 of rotor 10.

As shown in FIG. 2, the outer peripheral dimension of blade root 16 does not exactly match the peripheral dimension of the walls of cavity 18. As a result, gaps or spaces are formed between portions of root 16 and rotor 10. As described above in the background of the invention section, this inexact matching of the dimensions of root 16 and cavity 18 may be a result of an overhaul of the turbine rotor 10. Also, this inexact matching of the dimensions can be a result of inexact manufacturing of blade 12 and/or rotor 10.

In the FIG. 2 embodiment, three shims are disposed between blade 12 and the walls of cavity 18. A first shim 40 is disposed between the base of root 16 (the lowermost part of root 16 shown in FIG. 2) and a base portion of the cavity 18. A second shim 42 is disposed within one of the grooves 30 (the upper right-hand groove 30 of FIG. 2). Second shim 42 is disposed between surface 34 of this groove 30 and surface 38 of the lug 24 which extends into this groove 30. A third shim 44 is disposed in another groove 30 (the upper left side groove 30 in FIG. 2) between surface 34 of this groove 30 and surface 38 of the lug 24 which extends into this groove 30. Preferably, when cool (or at room temperature) shims 40, 42 and 44 fill enough of the gap or clearance between root 16 and rotor 10 to allow root 16 to snugly (although not necessarily tightly) fit within cavity 18. However, upon expansion of shims 40, 42 and 44, root 16 will be tightly secured within cavity 18, as described below.

Preferably, the shims 40, 42 and 44 are made of naturally occurring crystal layers of the expanding material (e.g., vermiculite or perlite), oriented to cause expansion of the shim thicknesses. That is, upon heating of shims 40, 42 and 44, the shims will expand in the directions of arrows 46 in FIG. 2. Additionally, it is preferred that the expanding material be a material which retains its expanded dimensions after heat is removed from the system (e.g., after the turbine assembly cools down).

Therefore, with reference to FIG. 2, upon heating of shim 40, root 16 and blade 12 will be urged in the upward direction with respect to FIG. 2. Similarly, upon heating of shim 42, root 16 and blade 12 will be urged upward and to the left with respect to FIG. 2. Additionally, heating of shim 44 will cause root 16 and blade 12 to be urged upward and to the right with respect to FIG. 2. Upon heating of all three shims 40, 42 and 44, simultaneously, as would naturally occur during the operation of the turbine, root 16 and blade 12 will be urged substantially upward with respect to FIG. 2. As a result, surface 36 of each lug 24 will be forced against surface 32 of each groove 30, and root 16 of blade 12 will be tightly secured in cavity 18 of rotor 10.

Shims 40, 42 and 44 may each comprise a monolithic strip of expanding material (e.g., vermiculite or perlite). Alternatively, each shim 40, 42 and 44 may be of a composite form of mineral layers alternated with a second material to provide properties tailored to the needs of the blading design and to enhance handling and installation characteristics. As another alternative, each shim 40, 42 and 44 may comprise a mixture of the expanding material (e.g., vermiculite or perlite) and a second material. This second material may be a binder such as a polymer or elastomer. The mixture can be set or formed into appropriately sized and shaped shims. It is also noted that metal or ceramic powders can be used as the second material which is mixed with the expanding material and which can produce shims in the form of pressed compacts.

FIG. 3 illustrates another embodiment of the present invention wherein blade 12 is secured or attached to rotor 10. In the FIG. 3 embodiment, the expanding material 48 is provided in a liquid vehicle 50. That is, the expanding material 48 is mixed with a liquid vehicle 50 to form a composite liquid. This composite liquid is applied to desired areas of blade root 16 or to the walls of cavity 18 prior to the insertion of root 16 in cavity 18. This composite liquid may be applied in a manner similar to the manner in which paint or lubricants are applied. This option allows the expanding material to be applied discriminately to specific areas wherein it is determined that a poor dimensional fit occurs. That is, the liquid vehicle 50 provides flexibility in the application such that the expanding material 48 may be applied in various locations (e.g., around curves or indentations) at which it would be difficult to position a shim. Furthermore, the composite liquid may be applied such that all clearance space between root 16 and rotor 10 is filled either before or after expansion of the expanding material.

Ideally, the system can be tailored to provide a variety of expansion properties versus application temperature ranges found in both combustion and steam driven turbines. A family of shim designs can be developed which provide for specific expansion dimensions based on tolerance and alignment requirements.

As is apparent from the foregoing description, the present invention provides a unique method and apparatus for securing or attaching a turbine blade to a turbine rotor such that movement or vibrations of the turbine blade with respect to the rotor can be minimized. Additionally, the expanding material employed in the present invention can be positioned so as to insure accurate alignment of the turbine blade with respect to the turbine rotor. Moreover, since the expanding material may be arranged to fill or take up any clearances which exist between a turbine blade and a turbine rotor, the outer peripheral dimension of the turbine blade root need not exactly match the peripheral dimension of the rotor cavity in which the root seats. Thus, a loss of metal on the rotor, due to a turbine overhaul may be compensated. Moreover, since the expanding material operates to compensate for gaps or clearances between the blade root and the rotor cavity walls, these parts need not be manufactured with exact dimensions.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed:

1. A turbine apparatus comprising:

a rotor having an outer peripheral surface provided with a cavity, said cavity having a surface;

a blade having a blade root extending within said cavity, said blade root having a surface; and a thermally expandable mineral silicate material provided between the surface of said blade root and the surface of said cavity, said thermally expandable material being thermally expandable to assume a permanently expanded state.

2. An apparatus as claimed in claim 1 wherein said thermally expandable material comprises a plurality of expandable shims, each shim having a thickness dimension extending between the surface of the blade root and the surface of the rotor cavity and being thermally expandable in the direction of the thickness dimension.

3. An apparatus as claimed in claim 1 wherein said thermally expandable material comprises a liquid applied to at least one of the surface of said blade root and the surface of said rotor cavity.

4. An apparatus as claimed in claim 1 wherein said thermally expandable material comprises at least one of a vermiculite and a perlite composition.

5. An apparatus as claimed in claim 1 wherein:

said cavity defines a groove in said outer peripheral surface of said rotor, said groove having an open end at said outer peripheral surface of said rotor and having a first surface facing toward said open end and a second surface facing away from said open end;

said blade root defines an outwardly extending lug having a third surface facing toward said open end and a fourth surface facing away from said open end;

said lug extends into said groove with said second surface contacting said third surface; and said thermally expandable material comprises a shim provided between the first and fourth surfaces.

6. An apparatus as claimed in claim 1 wherein:

said cavity defines an opening in said outer peripheral surface of said rotor;

said cavity has a first wall defining a plurality of grooves and a second wall defining a plurality of grooves, said first wall facing toward said second wall;

each groove having a first surface facing toward said opening and a second surface facing away from said opening;

said blade root has a third wall facing said first wall and a fourth wall facing said second wall;

said third and fourth walls each defining a plurality of outwardly extending lugs, each lug having a third surface facing toward said opening and a fourth surface facing away from said opening;

said plurality of lugs extend into said plurality of grooves with said second surfaces contacting said third surfaces; and said thermally expandable material comprises a first shim provided between the first surface of at least one groove provided in said first wall and the fourth surface of at least one lug provided in said third wall, and a second shim provided between the first surface of at least one groove provided in said second wall and the fourth surface of at least one lug provided in said fourth wall.

7. An apparatus as claimed in claim 1, wherein said thermally expandable material is thermally expandable by an amount to fill space between said blade root and said rotor.

8. An apparatus as claimed in claim 1, wherein said thermally expandable material is thermally expandable by an amount to urge said blade root against said rotor.

9. An apparatus as claimed in claim 1 wherein the thermally expandable material is in the form of at least one shim, the shim has a thickness dimension extending between the rotor cavity surface and the rotor blade root, and the shim is composed, before said step of expanding, of a plurality of layers of the mineral silicate oriented to expand in the direction of the thickness dimension.

10. A device for attaching the root of a rotor blade within a cavity of a rotor the rotor blade root having a surface and the rotor cavity having a surface, said device comprising a thermally expandable mineral silicate material disposed within the cavity said thermally expandable material being thermally expandable to a permanently expanded state.

11. A device as claimed in claim 10 wherein said thermally expandable material comprises a plurality of shims, each shim having a thickness dimension extending between the surface of the blade root and the surface of the rotor cavity and being expandable in the direction of the thickness dimension upon being heated.

12. A device as claimed in claim 10 wherein said thermally expandable material comprises a liquid provided between the surface of the blade root and the surface of the rotor cavity.

13. A device as claimed in claim 10 wherein said thermally expandable material comprises at least one of a vermiculite and a perlite composition.

14. A device as claimed in claim 10 wherein the thermally expandable material is in the form of at least one shim, the shim has a thickness dimension extending between the rotor cavity surface and the rotor blade root, and the shim is composed, before said step of expanding, of a plurality of layers of the mineral silicate oriented to expand in the direction of the thickness dimension.

15. A method of attaching the root of a rotor blade to a rotor having a blade root groove, said method comprising the steps of:

disposing a thermally expandable material on at least one of the root groove and the rotor blade root, said thermally expandable material comprising a mineral silicate and being expandable to a permanently expanded state;

disposing the blade root in the root groove with the thermally expandable material interposed between the blade root and the rotor; and expanding the thermally expandable material to assume a permanently expanded state.

16. A method as claimed in claim 15 wherein said step of providing a thermally expandable material comprises the steps of:

providing a liquid vehicle having the thermally expandable material therein; and applying the liquid vehicle to the peripheral; surface of at least one of the rotor blade root and the root groove.

17. A method as claimed in claim 15 wherein said thermally expandable material comprises at least one of a vermiculite and a perlite composition.

18. A method as claimed in claim 15, further comprising the step of expanding the thermally expandable material to fill space between the blade root and the rotor.

19. A method as claimed in claim 15, further comprising the step of expanding the thermally expandable material to urge the blade root against the rotor.

20. A method as claimed in claim 15 wherein the thermally expandable material is in the form of at least one shim.

21. A method as claimed in claim 20 wherein the shim has a thickness dimension extending between the root groove and the rotor blade root, and the shim is composed, before said step of expanding, of a plurality of layers of the mineral silicate oriented to expand in the direction of the thickness dimension.

22. A method as claimed in claim 15 wherein the thermally expandable material is in the form of a plurality of shims.

* * * * *